US005176000A

United States Patent [19]

Dauksis

[11] Patent Number: 5,176,000

[45] Date of Patent: Jan. 5, 1993

[54] HYBRID INTERNAL COMBUSTION ENGINE/ELECTRICAL MOTOR GROUND VEHICLE PROPULSION SYSTEM

[76] Inventor: William P. Dauksis, 91 Jennifer Cir., Ponce Inlet, Fla. 32127

[21] Appl. No.: 804,745

[22] Filed: Dec. 11, 1990

[51] Int. Cl.[5] ..... F01K 23/10

[52] U.S. Cl. ..... 60/618

[58] Field of Search ..... 60/618, 620, 39.18 R

[56] References Cited

U.S. PATENT DOCUMENTS

| | | | |
|---|---|---|---|
| 671,236 | 4/1901 | Renault | 60/618 X |
| 2,196,980 | 4/1940 | Campbell | 60/618 |
| 4,069,672 | 1/1978 | Milling | 60/618 |
| 4,405,029 | 9/1983 | Hunt | 60/618 X |

FOREIGN PATENT DOCUMENTS

| | | | |
|---|---|---|---|
| 454396 | 1/1928 | Fed. Rep. of Germany | 60/618 |
| 698393 | 11/1930 | France | 60/618 |
| 206709 | 12/1982 | Japan | 60/618 |
| 428261 | 4/1935 | United Kingdom | 60/618 |

*Primary Examiner*—Michael Koczo

[57] ABSTRACT

A hybrid internal combustion engine/electrical motor ground vehicle propulsion system is disclosed wherein a fluid is first heated in an internal combustion engine cylinder water jacket and then converted to its gaseous phase in a double walled manifold enshrouding the internal combustion engine exhaust manifold. The gas then turns a turbine, exits to a condenser where the gas is condensed into liquid, and then the fluid is returned to a radiator to await the next cycle. The turbine is rotatably connected to a generator which produces electrical energy when the turbine turns. This electrical energy is used to charge a bank of batteries. The bank of batteries is used to supply an electrical motor which may be used as a complementary or alternate source of propulsion for a ground vehicle.

4 Claims, 2 Drawing Sheets

HYBRID INTERNAL COMBUSTION ENGINE/ELECTRICAL MOTOR GROUND VEHICLE PROPULSION SYSTEM

BACKGROUND OF THE INVENTION

Field of the Invention

The present invention relates to ground vehicle propulsion systems and in particular to a hybrid internal combustion engine/electrical motor ground vehicle propulsion system.

Background of the Invention

The most common power plant used for ground vehicle propulsion is currently the internal combustion engine. The disadvantages associated with this means of energy conversion are numerous: air and noise pollution are produced and energy is squandered in the form of heat lost.

In addition, accessories such as air conditioning may only be operated while the internal combustion engine is being operated. Also, should the internal combustion engine fail, the ground vehicle is stranded with no backup propulsion system available to enable the ground vehicle to move.

One solution to the above problems has been the production of electric ground vehicles. These vehicles are quieter, less polluting and more energy efficient than their internal combustion engine powered counterparts. Stumbling blocks in the path towards implementing this solution have included lengthy battery charging times, dubious long distance highway cruise performance at speed and the distrust on the part of the general public of electrically propelled vehicles.

Description of the Prior Art

A number of methods have been advanced to overcome the above mentioned problems.

U.S. Pat. No. 4,075,545 was granted Haberer for a charging system for automobile batteries wherein a pair of impeller rotors mounted in the front end portion of a vehicle and operatively connected to one or more generators charged drive motor energizing batteries in response to forward motion of the vehicle.

Stoeckert was granted U.S. Pat. No. 3,876,925 for a wind turbine driven generator to recharge batteries in electric vehicles. Stoeckert taught a turbine mounted in or on the roof of a ground vehicle which would be urged to rotate in the presence of the relative wind experienced by the turbine blades due to the motion of the vehicle. This turbine would drive a generator which charged a bank of batteries.

The disadvantages associated with both these methods of ground vehicle propulsion include the fact that the vehicle must be in motion in order to operate the charging system. Should the sole propulsion means (the electric motor) malfunction, the vehicle would be stranded, and the general public's distrust of purely electric vehicles would remain an obstacle.

SUMMARY OF THE INVENTION

Accordingly, it is an object of this invention to provide a hybrid internal combustion engine/electrical motor ground vehicle propulsion system capable of utilizing the excess heat generated by the internal combustion engine, to charge electric motor energizing batteries.

It is another object of this invention to provide a hybrid internal combustion engine/electrical motor ground vehicle propulsion system which would reduce the air and sound pollution of a standard internal combustion engine driven ground vehicle.

It is a further object of this invention to provide a hybrid internal combustion engine/electrical motor ground vehicle propulsion system which would reduce the consumption of fossil fuels used by internal combustion engines.

It is still a further object of this invention to provide a hybrid internal combustion engine/electrical motor ground vehicle propulsion system capable of running accessories such as the vehicle air conditioning system while the internal combustion engine is not running.

It is a further object of this invention to provide a hybrid internal combustion engine/electrical motor ground vehicle propulsion system wherein the internal combustion engine and the electric motor may be operated simultaneously in order to provide enhanced vehicle performance.

It is still a further object of this invention to provide a hybrid internal combustion engine/electrical motor ground vehicle propulsion system wherein the electric motor energizing batteries may be charged conventionally using a source external to the vehicle.

It is another object of this invention to provide a hybrid internal combustion engine/electrical motor ground vehicle propulsion system wherein the internal combustion engine or the electric motor may be used to propel the vehicle, thereby enhancing reliability.

It is a further object of this invention to provide a hybrid internal combustion engine/electrical motor ground vehicle propulsion system whose reliability and use of the familiar internal combustion engine would serve to help overcome the general public's distrust of purely electric ground vehicles.

BRIEF DESCRIPTION OF THE DRAWINGS

The invention, together with the other objects, features, aspects and advantages thereof will be more clearly understood from the following in conjunction with the accompanying drawings.

DETAILED DESCRIPTION OF THE PREFERRED EMBODIMENT

Figure 1:
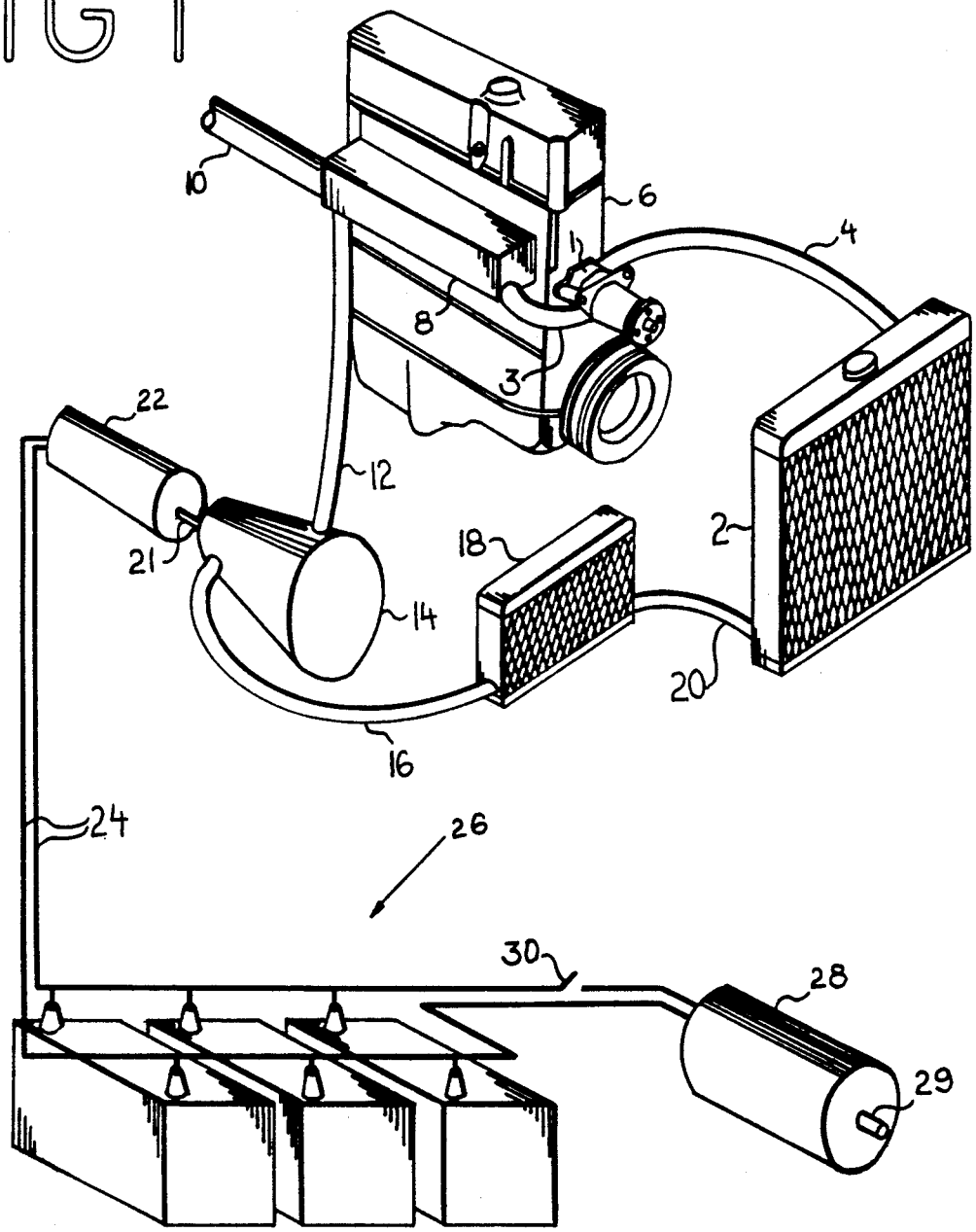
FIG. 1 is a front isometric view of the hybrid internal combustion engine/electrical motor ground vehicle propulsion system showing its various components.

Referring now to FIG. 1 we can observe radiator 2 connected to internal combustion engine 6 by means of hose 4. Internal combustion engine 6 is connected to double walled manifold 8 by means of hose 3. Double walled manifold 8 shrouds exhaust manifold 10.

Double walled manifold 8 is connected to turbine 14 by means of hose 12. Turbine 14 is connected to condenser 18 by means of hose 16; hose 20 connects condenser 18 to radiator 2.

Turbine 14 is mechanically connected to generator 22 by means of turbine shaft 21 such that turbine 14 may turn generator 22 in order to produce electricity. Generator 22 is electrically connected to battery bank 26 by means of cables 24; closing switch 30 allows the electricity stored in battery bank 26 to drive electric motor 28.

When switch 30 is closed electric motor 28 turns electric motor drive shaft 29 which may be used as a source of ground vehicle propulsion.

Figure 2:
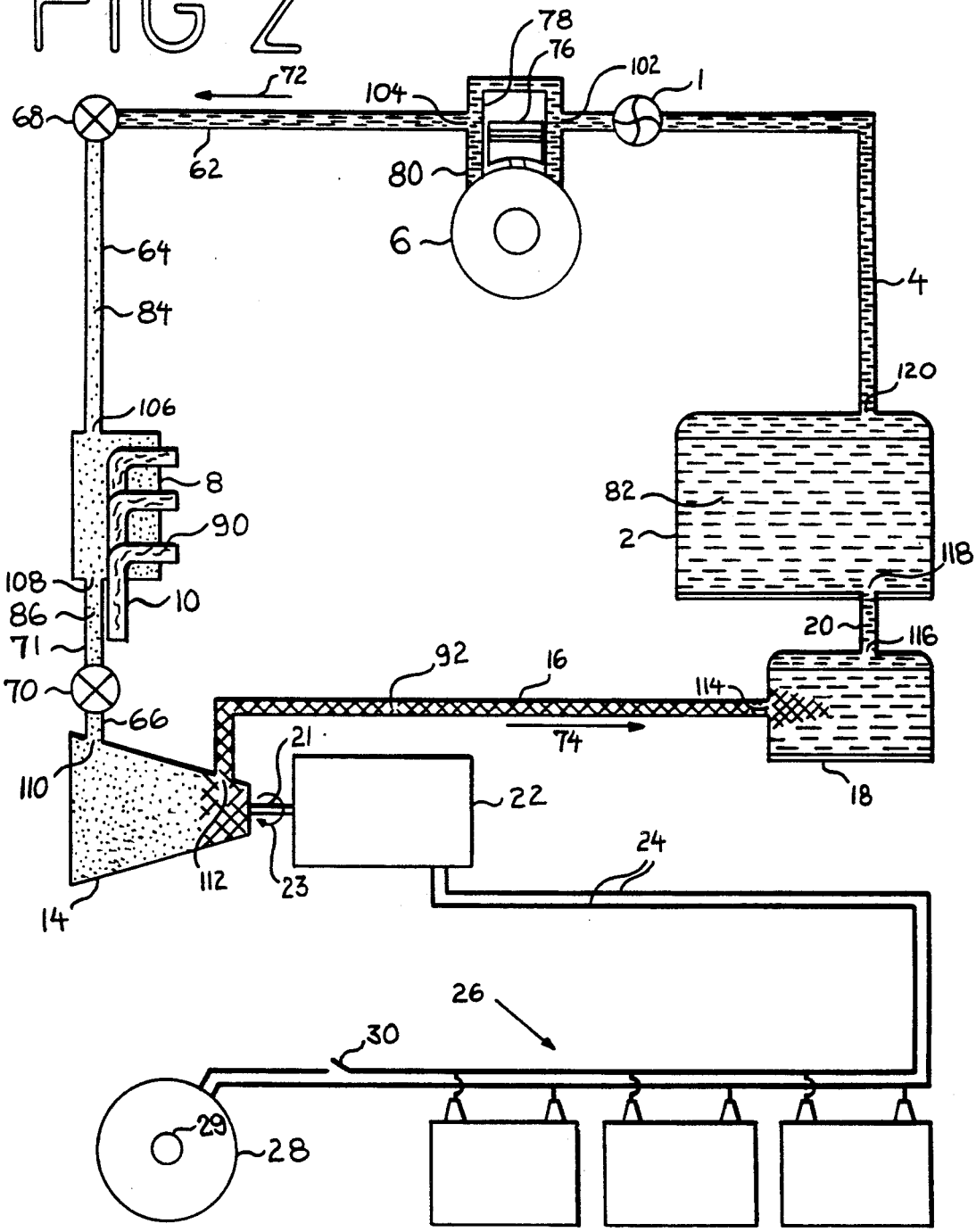
FIG. 2 is a schematic view of the hybrid internal combustion engine/electrical motor ground vehicle propulsion system.

FIG. 2 is a schematic view of the hybrid internal combustion engine/electrical motor ground vehicle propulsion system. We can observe radiator 2 connected to internal combustion engine 6 by means of hose 4. Specifically, hose 4 connects with cylinder water jacket 80 which surrounds cylinder 78 containing piston 76. A fluid pump 1 is connected between the radiator outlet 120 and cylinder water jacket intake 102.

Hose 62 connects cylinder water jacket outlet 104 with low temperature thermostat 68 (although low temperature thermostat 68 may be mounted directly to the cylinder water jacket 80 wall in which case hose 62 would be omitted). Hose 64 connects low temperature thermostat 68 to double walled manifold intake 106. Double wall manifold 8 enshrouds exhaust manifold 10.

High temperature thermostat 70 is connected with double walled manifold outlet 108 by means of hose 71, and with turbine intake 110 by means of hose 66. Condenser intake 114 connects with turbine outlet 112 by means of hose 16. Condenser outlet 116 connects with radiator intake 118 by means of hose 20.

Turbine 14 is rotatably connected with generator 22 by means of turbine shaft 21. Cables 24 connect generator 22 electrically with battery bank 26. Closing switch 30 allows battery bank 26 to supply electrical power to electric motor 28 which turns electric motor drive shaft 29.

Operation

The cycle starts with low temperature fluid 82 (which may be water, antifreeze or a combination thereof) filling radiator 2, hoses 4 and 62 and cylinder water jacket 80. When heat transferred from cylinder 78 to low temperature fluid 82 causes the temperature of low temperature fluid 82 to rise to the threshold temperature to which low temperature thermostat 68 is calibrated, low temperature thermostat 68 opens, allowing low temperature fluid 82 to flow into hose 64, double walled manifold 8 and hose 71 in the direction indicated by flow arrow 72. Circulation is aided by fluid pump 1. When cooler low temperature fluid 82 from radiator 2 reaches low temperature thermostat 68, low temperature thermostat 68 will close.

The fluid within hose 64, double walled manifold 8 and hose 71 is heated by exhaust gas 90 within exhaust manifold 10, changing phase from high temperature fluid 84 into high pressure gas 86. When high pressure gas 86 reaches the appropriate threshold temperature to which high temperature thermostat 70 is calibrated, high temperature thermostat 70 opens, allowing high pressure gas to turn turbine 14 which turns generator 22 as indicated by rotation arrow 23, thereby charging battery bank 26.

Low pressure gas 92 exits turbine 14 into hose 16 which conducts the low pressure gas 92 into condenser 18 as indicated by flow arrow 74. Condenser 18 condenses low pressure gas 92 into low temperature fluid 82, which is then sent to radiator 2 via hose 20, ready to once again enter cylinder water jacket 80 through hose 4.

Battery bank 26 may be used to power electric motor 28. Electric motor 28 may be used as a source of propulsion for a ground vehicle.

Typical hybrid internal combustion engine/electrical motor ground vehicle propulsion system operation modes may include electric motor only for city driving, combined electric/internal combustion propulsion for enhanced ground vehicle performance (for added acceleration, for instance) and internal combustion only for long distance, high speed highway travel. In the case of failure of either powerplant the alternate propulsion mode may be utilized to increase reliability of the ground vehicle.

While a preferred embodiment of the invention has been illustrated herein, it is to be understood that changes and variations may be made by those skilled in the art without departing from the spirit and scope of the appending claims.

I claim:

1. A hybrid internal combustion engine/electrical motor ground vehicle propulsion system comprising:

a radiator having an intake and an outlet, an internal combustion engine whose design incorporates a cylinder water jacket having an intake and an outlet surrounding its cylinders and an exhaust manifold, a means of connecting said radiator outlet to the intake of said cylinder water jacket in a watertight manner, a double walled manifold having an intake and an outlet surrounding said exhaust manifold, a means of connecting the outlet of said cylinder water jacket to the intake of said double walled manifold in a watertight manner, a turbine having an intake and an outlet, a means of connecting the outlet of said double walled manifold to the intake of said turbine in a watertight manner, a condenser having an intake and an outlet, a means of connecting the outlet of said turbine to the intake of said condenser in a watertight manner, a means of connecting the outlet of said condenser to the intake of said radiator in a watertight manner, a fluid contained within said radiator, said cylinder water jacket, said double walled manifold, said turbine, said condenser and said means of connecting said radiator outlet to said cylinder water jacket intake, said cylinder water jacket outlet to said double walled manifold intake, said double walled manifold outlet to said turbine intake, said turbine outlet to said condenser intake and said condenser outlet to said radiator intake, a low temperature thermostat through which the fluid flowing from said cylinder water jacket to said double walled manifold must pass, connected in a waterproof manner between said cylinder water jacket and said double walled manifold, a high temperature thermostat through which the fluid flowing from said double walled manifold to said turbine must pass, connected in a watertight manner between said double walled manifold and said turbine, a means of circulating said fluid, a generator rotatably connected to said turbine, a battery bank electrically connected to said generator, a switch electrically connected to said battery bank, an electric motor electrically connected to said switch, whereby said switch may electrically connect or disconnect said electric motor to said battery bank.

2. The hybrid internal combustion engine/electrical motor ground vehicle propulsion system of claim 1 wherein the means of connecting said radiator outlet to said cylinder water jacket intake, said cylinder water jacket outlet to said double walled manifold intake, said double walled manifold outlet to said turbine intake, said turbine outlet to said condenser intake and said condenser outlet to said radiator intake is flexible hose.

3. The hybrid internal combustion engine/electrical motor ground vehicle propulsion system of claim 2 wherein the fluid circulating means is an automotive coolant fluid pump.

4. The hybrid internal combustion engine/electrical motor ground vehicle propulsion system of claim 3 wherein said fluid is water, antifreeze, or a combination thereof.

* * * * *